United States Patent [19]

Ito et al.

[11] Patent Number: 4,755,975

[45] Date of Patent: Jul. 5, 1988

[54] PIEZOELECTRIC TRANSDUCER FOR TRANSMITTING OR RECEIVING ULTRASONIC WAVES

[75] Inventors: Toshiharu Ito, Seto; Eiji Ozeki, Nagoya, both of Japan

[73] Assignee: NGK Spark Plug Co., Ltd., Japan

[21] Appl. No.: 825,889

[22] Filed: Feb. 4, 1986

[30] Foreign Application Priority Data

Feb. 8, 1985 [JP] Japan ..... 60-17648
Feb. 19, 1985 [JP] Japan ..... 60-31285
Feb. 19, 1985 [JP] Japan ..... 60-31286

[51] Int. Cl.[4] ..... H04R 1/02; H04R 17/00

[52] U.S. Cl. ..... 367/140; 367/180; 367/188; 310/322; 310/324; 381/205

[58] Field of Search ..... 367/140, 2, 178, 180, 367/188; 181/0.5, 123, 139, 140, 142; 310/324, 322, 344; 179/110 A; 340/943, 621, 384 E; 381/114, 173, 190, 205

[56] References Cited

U.S. PATENT DOCUMENTS 3,943,388 3/1976 Massa ..... 310/324 X
4,063,049 12/1977 Pipitone et al. ..... 179/110 A
4,122,365 10/1978 Stephens ..... 310/324
4,190,783 2/1980 Massa ..... 310/324
4,356,423 10/1982 Gudzin ..... 310/344 X

FOREIGN PATENT DOCUMENTS 3525724 2/1986 Fed. Rep. of Germany ... 179/110 A
57-56099 of 1982 Japan .
101600 6/1983 Japan ..... 179/110 A

*Primary Examiner*—Deborah L. Kyle
*Assistant Examiner*—Brian Steinberger
*Attorney, Agent, or Firm*—Larson and Taylor

[57] ABSTRACT

A piezoelectric transducer in which a casing is mounted in a sealing manner on a base member for supporting two rod-shaped terminals, a piezoelectric element is bonded to the inner surface of said casing, and electrodes on the front and back surfaces of said piezoelectric element are electrically connected to said terminals. The transducer is supported at the position of a node of the free oscillation mode or the forced oscillation mode. The interior of the casing in the transducer is filled with nitrogen gas.

8 Claims, 4 Drawing Sheets

PIEZOELECTRIC TRANSDUCER FOR TRANSMITTING OR RECEIVING ULTRASONIC WAVES

FIELD OF THE INVENTION

This invention relates to a piezoelectric transducer which may be used as a transmitter for transmitting an ultrasonic wave with a piezoelectric element as an oscillator or a receiver for receiving a sound wave. The piezoelectric transducer according to this invention is capable of being applied for example, to a sensor mounted on a vehicle for sensing obstacles existing behind the vehicle.

BACKGROUND OF THE INVENTION

Piezoelectric transducers of this type are well known as an ultrasonic ceramic microphone in which a resonance characteristic of a piezoelectric element is utilized to resonate at a specific frequency. It is known that the ultrasonic ceramic microphone has relatively high sensitivity at a specific frequency, and thus is conveniently used as a transmitter for generating a predetermined ultrasonic wave or a receiver for receiving such a ultrasonic wave.

In a conventional ultrasonic ceramic microphone, a piezoelectric ceramic oscillator is bonded to the bottom inside of a bottomed cylindrical casing which is reduced in thickness of the bottom portion as compared with that of side portion so as to decrease the influence due to the side supporting, and a terminal board is mounted in an opening of the casing by means of an elastic adhesive. In this case, the shape of the casing is cylindrical and the side portion thereof is thicker than that of the bottom portion on which the piezoelectric ceramic oscillator is disposed. Thus, the substantial mass of the assembly is increased, and the Q of the vibration is also increased. Therefore, the Q of the acoustic resonance is high so that the frequency band is disadvantageously narrowed. Further, since the casing does not have a constant thickness, the machining thereof is costly.

An ultrasonic ceramic microphone which can eliminate said disadvantages is disclosed in Japanese Utility Model Kokai No. 56099/82, in which it comprises a frustoconical casing having a bottom portion at one end and an opening at the other end thereof, a piezoelectric ceramic oscillator bonded to the inner surface of the bottom portion of the casing, and a terminal board mounted on the opening of the casing. Such ultrasonic ceramic microphone may be usually fixed on a suitable mounting member and may be used for transmitting or receiving a ultrasonic wave.

With the ultrasonic ceramic microphone fixed on the mounting member, when the microphone is to be used as a transmitter for transmitting a ultrasonic wave, the oscillation is leaked out through the terminal board to the mounting member so that the output level decreases, and the mounting member is vibrated to produce a noise. When the microphone is to be used as a receiver for sensing a ultrasonic wave, the vibration from the mounting member is propagated through the terminal board to the piezoelectric ceramic oscillator bonded to the inner surface of the casing, and a noise is introduced into the output signal, thereby reducing the signal-to-noise ratio of the microphone.

In the conventional ultrasonic ceramic microphone, usually, the space in the casing sealed by the terminal board is filled with the air. Therefore, the adhesive of the bonding surface of the piezoelectric element is feasibly deteriorated by moisture or oxygen in the air, various aging changes occur in the casing, in which electrode films are rusted, causing the performance to be deteriorated or some other trouble, thereby decreasing the life of the device.

It is appreciated that a base portion such as terminal board in an ultrasonic ceramic microphone has a forced oscillation mode and a free oscillation mode. The former remarkably occurs at the frequency lower than 40 KHz, and the latter at frequency higher than 40 KHz. When the diameter of the base portion is represented by "D", in the forced oscillation mode the base portion bendably vibrates in such a manner that a node lines in the position of 0.40 D to 0.45 D, theoretically, 0.417 D from the center of the base portion, and in the free oscillation mode the base portion vibrates in such a manner that a node lies in the position of 0.30 D to 0.35 D, theoretically, 0.33 D from the center of the base portion.

It is, therefore, an object of this invention to provide a piezoelectric transducer for transmitting or receiving an ultrasonic wave which can insulate a vibration between a piezoelectric element and a mounting member and improve the transmitting sound pressure level and the receiving sensitivity.

Another object of the invention is to provide a piezoelectric transducer for transmitting or receiving an ultrasonic wave in which an influence of the atmosphere can be substantially eliminated, thereby extending the durable life.

A further object of the invention is to provide a piezoelectric transducer for transmitting or receiving an ultrasonic wave which is to be used in a backward view sensor system for a vehicle.

SUMMARY OF THE INVENTION

According to a first aspect of this invention there is provided a piezoelectric transducer for transmitting or receiving an ultrasonic wave wherein it comprises a piezoelectric element adapted for transducing an electrical signal into an ultrasonic signal or vice versa and having electrodes on the front and back surfaces thereof, a casing for supporting said piezoelectric element on its inner surface and having an opening at one end and base member adapted for sealing the opening of said casing and for supporting two rod-shaped terminals which are electrically connected to the respective electrodes of said piezoelectric element, the ratio (f) of the weight of said base member to that of said casing including said piezoelectric element is set to 1.5 or lower, when the diameter of said base member is D, said terminals are positioned at a distance of 0.30 D to 0.35 D from the center of said base member so that the terminals are symmetrical with respect to the center of said base member, and said terminals are mounted on a mounting member.

The casing comprises a frustoconical metal casing having a peripheral flange onto which the peripheral portion of the base member is tightly secured.

The base member comprises a disc-shaped member made of a conductive material into which one of the rod-shaped terminals is inserted and electrically insulated by means of an insulating material.

According to a second aspect of this invention, there is provided a piezoelectric transducer for transmitting or receiving an ultrasonic wave wherein it comprises a piezoelectric element adapted for transducing an electrical signal into an ultrasonic signal or vice versa and having electrodes on the front and back surfaces thereof, a casing for supporting said piezoelectric element on its inner surface and having an opening at one end and base member adapted for sealing the opening of said casing and for supporting two rod-shaped terminals which are electrically connected to the respective electrodes of said piezoelectric element, the ratio (f) of the weight of said base member to that of said casing including said piezoelectric element is set to 2 or higher, and when the diameter of said base member is D, the assembly is supported by a mounting member at the portion which is positioned at a distance of 0.40 D to 0.45 D from the center of said base member.

In a preferred embodiment, the interior of the casing is filled with nitrogen.

BRIEF DESCRIPTION OF THE DRAWINGS

The above and other objects, features, and advantages of the invention will become apparent upon consideration of the following detailed description taken in connection with the accompanying drawings.

DETAILED DESCRIPTION

Figure 1:
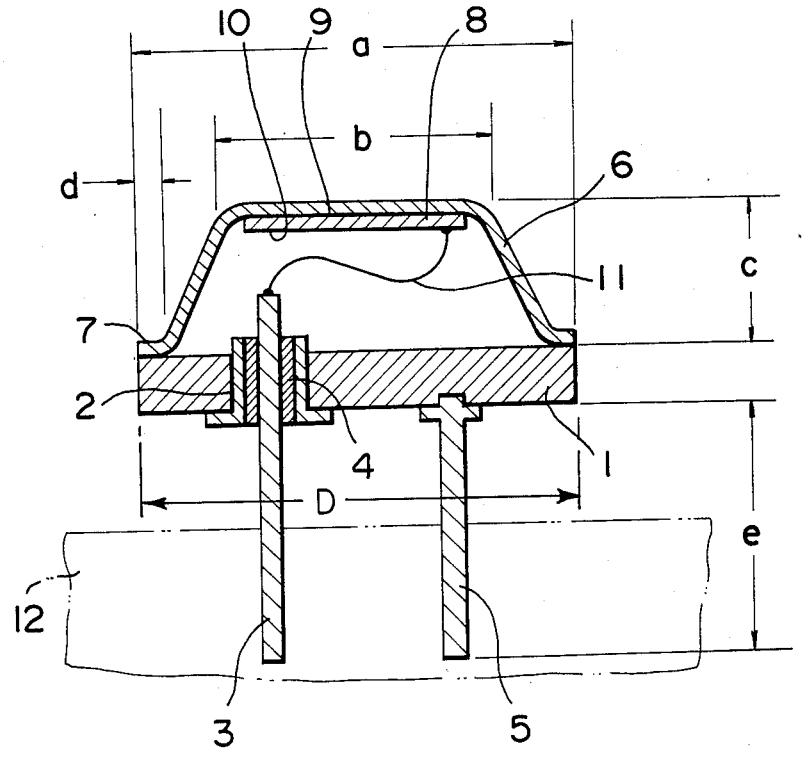
FIG. 1 is a longitudinal sectional view showing an embodiment of a piezoelectric transducer according to this invention.

Reference is now made to FIG. 1 of the drawings wherein an embodiment of this invention is shown.

Reference numeral 1 designates a disc-shaped metal base member which is provided with a hole 2 for supporting a rod-shaped terminal 3. The rod-shaped terminal 3 is inserted into the hole 2, and electrically insulated and held with the base member 1 by means of a glass seal member 4 or the like filled into the gap between the hole 2 and the periphery of the inserted terminal 3. At the symmetrical position of the hole 2 with respect to the center of the base member 1 a second rod-shaped terminal 5 is provided on the outer surface of the base member 1. The second terminal 5 may be an earth terminal.

Reference numeral 6 designates a frustoconical metal casing opened at a lower portion which is provided with a peripheral flange 7 onto which the peripheral portion of the base member 1 is secured by welding or any other suitable means so that the interior space in the metal casing 6 is closed watertightly and airtightly. On the inner surface of the metal casing 6 is secured a sheet-shaped piezoelectric element 8 which is made of a piezoelectric material such as PZT. This piezoelectric element 8 is provided with an electrode 9 on one surface thereof which is bonded to the inner surface of the metal casing 6 and an electrode 10 on the other surface which is connected to the first terminal 3 by a conductor wire 11.

In the arrangement as described above, the transmitting sound pressure level (dB) and the receiving sensitivity (dB) were measured for the various weight ratios (f) of the weight of the base member 1 to that of the metal casing 6 including the piezoelectric element 8 under the following conditions:

The metal casing 6: made of stainless steel, weight=2.2 g, a=18 mm, b=11 mm, c=6 mm and d=1 mm;

The piezoelectric element 8: made of lead zircotitanate, weight=0.1 g, diameter=9 mm and thickness=0.3 mm;

The base member 1: there were prepared five samples made of stainless steel having different weight (2.3 g, 3.45 g, 4.6 g, 5.75 g and 6.9 g), diameter of each sample=18 mm and thickness decided at every sample in accordance with the set weight;

The rod-shaped terminals: made of iron-nickel alloy, diameter=1 mm and e=10 mm.

By using the samples of the base member 1 five piezoelectric transducers having different weight ratios (f) were prepared.

Figure 2:
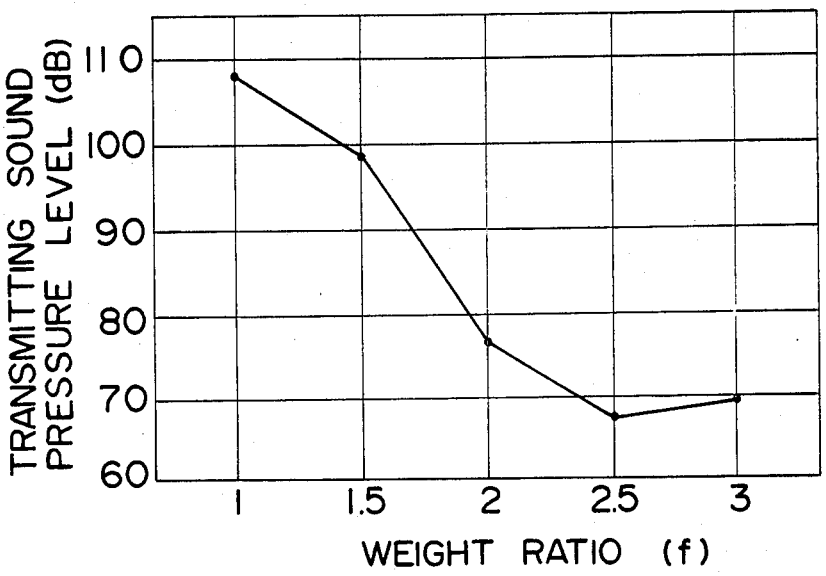
FIG. 2 is a graph showing the relationship between the weight ratio and transmitting sound pressure level in the free oscillation mode.
Figure 3:
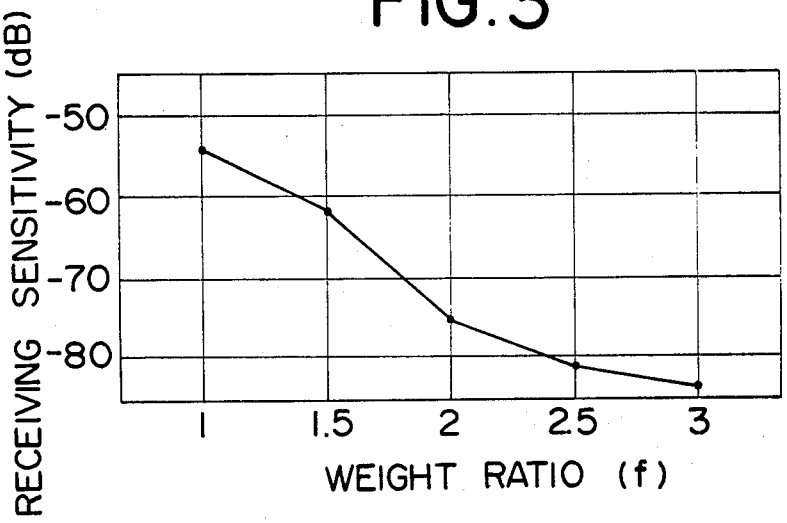
FIG. 3 is a graph showing the relationship between the weight ratio and the receiving sensitivity in the free oscillation mode.

When the piezoelectric transducers were operated in the free oscillation mode, the transmitting sound pressure level and the receiving sensitivity of the each transducer were measured, and the results were as shown in FIGS. 2 and 3.

As shown in FIG. 2, the transmitting sound pressure level was 108 dB in case of f=1, and 99 dB in case of f=1.5 in the free vibration mode, and as the weight ratio f increased, the transmitting sound pressure level abruptly dropped. The relationship between the weight ratio f and the receiving sensitivity was as shown in FIG. 3.

As shown in FIG. 3, it was −54 dB in case of f=1 and −55.5 dB in case of f=1.5 in the free vibration mode, and as the weight ratio f thereafter increased, the receiving sensitivity abruptly dropped.

When the results are generalized, it is found out that the performance of the each transducer can be improved if the weight ratio is set to f=1.5 or lower.

Figure 4:
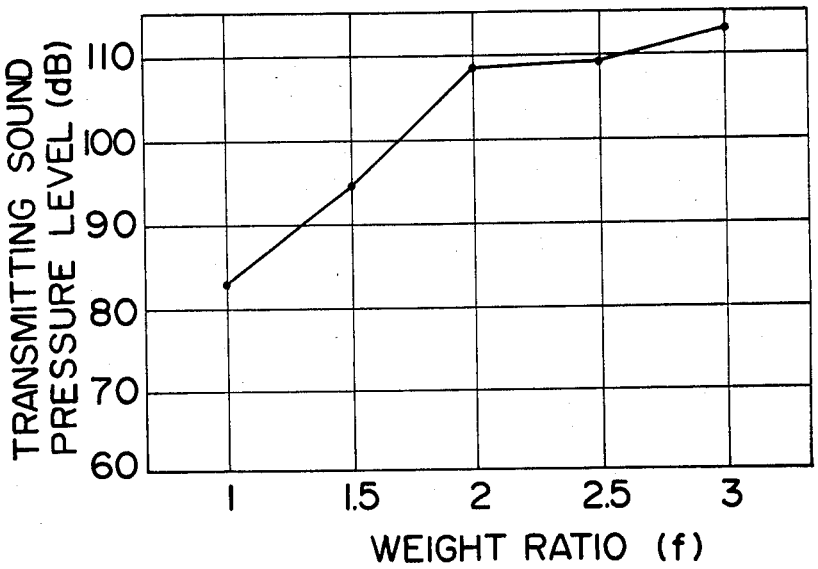
FIG. 4 is a graph showing the relationship between the weight ratio and transmitting sound pressure level in the forced oscillation mode.
Figure 5:
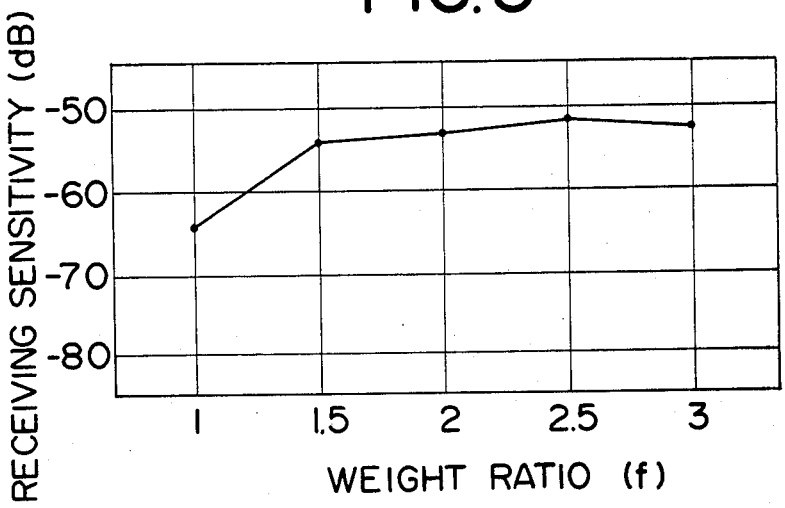
FIG. 5 is a graph showing the relationship between the weight ratio and the receiving sensitivity in the forced oscillation mode.

FIGS. 4 and 5 show the measured results in the forced oscillation mode.

As shown in FIG. 4, the transmitting sound pressure level was 84 dB in case of f=1 in the forced oscillation mode, and abruptly risen to 108 dB in case of f=2, 109 dB in case of f=2.5, and 113 dB in case of f=3, and as the weight ratio f increased, the transmitting sound presure level gradually increased. In the relationship between the weight ratio f and the receiving sensitivity as shown in FIG. 5, the receiving sensitivity became −64 dB in case of f=1, abruptly rose to −55.5 dB in case of f=1.5, further −53.5 dB in case of f=2, −52 dB in case of f=2, and −53 dB in case of f=3, and as the weight ratio f thereafter increased, the receiving sensitivity gradually increased.

the results are generalized, it is found out that the performance of the each transducer can be improved when the weight ratio is set to f=2 or higher.

According to this invention, therefore, in order to optimally apply to the frequency range for vibrating in the free oscillation mode, the rod-shaped terminals 3 and 5 are positioned at the distance of 0.30 D to 0.35 D (D: the diameter of the base member 1) from the center of the base member 1 so that the terminals 3 and 5 are symmetrical with respect to the center of the base member 1, thereby setting each terminals at the position of the node of the free oscillation mode.

As shown in FIG. 1, the transducer is supported by a mounting member 12 at the terminals 3 and 5 so as to eliminate the transmission of the vibration from the piezoelectric element 8 to the mounting member 12 and obviate noise due to the propagation of the vibration from the mounting member 12 to the piezoelectric element 8. In this case, the terminals 3 and 5 may be supported simply by engaging them with the mounting member 12 of FIG. 1.

Figure 6:
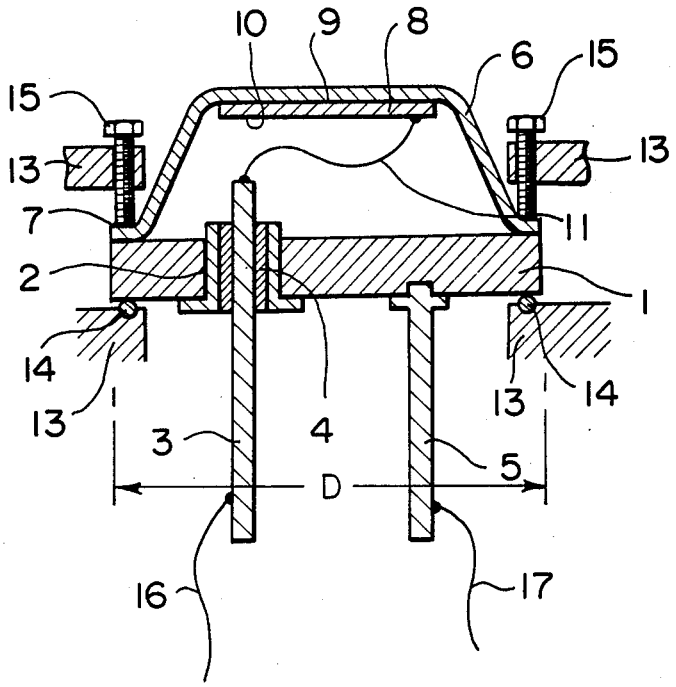
FIG. 6 is a longitudinal sectional view showing another embodiment according to this invention.

For the forced oscillation mode, as shown in FIG. 6, the transducer is supported by a mounting member 13 at the periphery of the base member 1 which lies in the position of 0.40 D to 0.45 D from the center of the base member 1.

In FIG. 6, in order to support the transducer by the mounting member 13, a supporting seat 14 formed at the lower portion of the mounting member 13 is contacted with the periphery of the base member 1 at the position of 0.40 D to 0.45 D from the center of the base member 1, and the end of a clamping screw 15 engaged with the upper portion of the mounting member 13 is held at the position of 0.40 D to 0.45 D from the center of the base member 1.

In this case, in order to interrupt the vibration between the terminals 3 and 5 and a connecting device (not shown), the terminals 3 and 5 should be electrically connected by a conductive coil material such as lead wires 16 and 17 with the connecting device.

As described above the transducer according to this invention is arranged to be supported at the position of the node of the free oscillation mode or the forced oscillation mode to optimally apply to the frequency range for vibrating in the free oscillation mode or the forced oscillation mode and optimizes the weight ratio f of the weight of the base member to the weight of the metal casing. Therefore, the vibration between the mounting member and the transducer may be insulated to remarkably reduce the vibration leakage of mounting member in case of using as a transmitter and the decrease in the S/N ratio due to the propagation of the vibration from the mounting member in case of using as a receiver, thereby improving the performance of the transducer.

Figure 7:
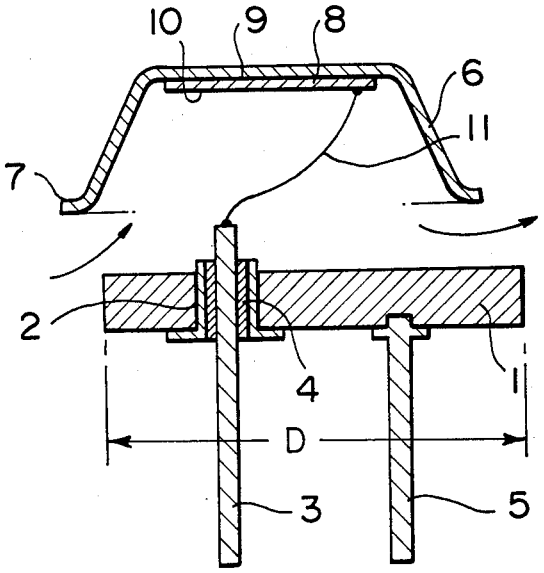
FIG. 7 is a longitudinal sectional view showing filling of nitrogen gas into a metal casing.

FIG. 7 shows how the space of the interior defined by the metal casing 6 and the base member 1 is filled with nitrogen gas.

When the base member 1 and the casing 6 are welded, the piezoelectric element 8 and the rod-shaped terminal 3 are completely connected by the conductor 11, and nitrogen is filled into the casing 6 as designated by an arrow in FIG. 7 with the opening of the case disposed at the lower position. At this time, since the nitrogen is slightly lighter than the air, the air in the casing 6 is evacuated, and the nitrogen is retained in the casing 6. Then, the lower opening of the casing 6 is shielded by the base member 1, and the collar 7 and the base member 1 are welded as described above.

The molecular weight of the nitrogen gas is similar to the air. Thus, the nitrogen can be filled by the simple means described above, and even if the nitrogen is sealed in the space and becomes lower than the atmospheric pressure, a pressure difference which may be occurred is slight, and the casing 6 may sufficiently endure against the external pressure.

In addition, the nitrogen gas is harmless and is accordingly optimum as the filling gas.

With nitrogen gas filled in the space of the metal casing 6 sealed therein by the base member 1 as described above. Therefore, the atmosphere in the casing 6 can be chemically stabilized to prevent the adhesive used for the connectors from deteriorating, and the metal surface from oxidizing, thereby reducing the decrease in the performance and troubles and increasing the durable life.

While this invention has been described in detail with respect to a certain now preferred embodiment of the invention, it will be understood by those skilled in the art that various canges and modifications may be made without departing from the spirit and scope of the invention, and it is intended, therefore, to cover all such changes and modification in the appended claims.

What is claimed is:

1. A piezoelectric transducer for transmitting or receiving an ultrasonic wave wherein said transmitter comprises a piezoelectric element, having a front surface and a back surface, for transducing an electrical signal into an ultrasonic signal or vice versa and having electrodes on said front and back surfaces thereof, a casing having an inner surface supporting said piezoelectric element thereon and having an opening at one end, two rod-shaped terminals which are electrically connected to the respective electrodes of said piezoelectric element, and a base member, having a center, for sealing the opening of said casing and for supporting said two rod-shaped terminals, and wherein the ratio (f) of the weight of said base member to that of said casing including said piezoelectric element is at least as low as 1.5, when the diameter of said base member is D, said terminals are positioned at a distance of 0.30 D to 0.35 D from the center of said base member so that the terminals are symmetrical with respect to the center of said base member, and said terminals are mounted on a mounting member.

2. A piezoelectric transducer as claimed in claim 1, wherein the casing comprises a frustoconical metal casing having a peripheral flange onto which a peripheral portion of the base member is tightly secured.

3. A piezoelectric transducer as claimed in claim 1, wherein the casing has an interior which is filled with nitrogen.

4. A piezoelectric transducer as claimed in claim 1, wherein the base member comprises a disc-shaped sheet made of a conductive material.

5. A piezoelectric transducer as claimed in claim 4, further comprising insulating means for electrically insulating one of the rod-shaped terminals from the base member, the other terminal being directly electrically connected to the base member.

6. A piezoelectric transducer as claimed in claim 1, wherein the terminals are supported by engagement with the mounting member.

7. A piezoelectric transducer for transmitting or receiving an ultrasonic wave wherein said transducer comprises a transducer assembly comprising a piezoelectric element, having a front surface and a back surface, for transducing an electrical signal into an ultrasonic signal or vice versa and having electrodes on said front and back surfaces thereof, a casing having an inner surface supporting said piezoelectric element thereon and having an opening at one end, two rod-shaped terminals which are electrically connected to the respective electrodes of the piezoelectric element and a base member, having a center, for sealing the opening of said casing and for supporting said two rod-shaped terminals, and wherein the ratio (f) of the weight of said base member to that of said casing including said piezoelectric element is at least 2, and when the diameter of said base member is D, the transducer assembly is supported by a mounting member at a portion thereof which is located at a distance of 0.40 D to 0.45 D from the center of said base member.

8. A piezoelectric transducer as claimed in claim 7, wherein the transducer assembly is supported on the mounting member by clamping means.

* * * * *